United States Patent [19]

Spaziante et al.

[11] Patent Number: 4,981,563

[45] Date of Patent: Jan. 1, 1991

[54] ELECTROLYSIS CELL AND METHOD OF PRODUCING CHLORINE

[75] Inventors: Placido M. Spaziante, Lugano, Switzerland; Pitaya Yangpichit, Bangkok, Thailand

[73] Assignee: Panclor (Thailand) Co., Ltd., Bangkok, Thailand

[21] Appl. No.: 465,531

[22] Filed: Jan. 17, 1990

Related U.S. Application Data

[63] Continuation-in-part of Ser. No. 252,919, Oct. 4, 1988, abandoned.

[30] Foreign Application Priority Data

Oct. 6, 1987 [CH] Switzerland ..... 03889/87

[51] Int. Cl.[5] ..... C25B 1/26; C25B 9/00

[52] U.S. Cl. ..... 204/128; 204/263; 204/283; 204/290 R; 204/292; 204/293

[58] Field of Search ..... 204/98, 128, 263, 252, 204/283, 290 R, 292, 293, 280

[56] References Cited

U.S. PATENT DOCUMENTS 4,177,116 12/1979 DeNora et al. ..... 204/283

4,292,197 9/1981 Chamberlain ..... 204/290 R 4,417,959 11/1983 Kadija et al. ..... 204/98

FOREIGN PATENT DOCUMENTS 2069006 8/1981 United Kingdom .

*Primary Examiner*—John F. Niebling

*Assistant Examiner*—Kathryn Gorgos

*Attorney, Agent, or Firm*—Browdy and Neimark

[57] ABSTRACT

A membrane electrolysis cell, particularly suited for producing chlorine, caustic soda and hydrogen by the electrolysis of brine, has its cathode formed by a static bed of a packing material capable of withstanding the cathodic conditions confined between the membrane and a current distribution-baffle plate, parallel and spaced from the membrane. The current distribution plate defines a space within the cathodic compartment through which de-gassed catholyte downflows toward the bottom of the compartment for raising again through the interstices of the cathodic static bed. The internal recycling motion permits a rapid evacuation the gas evolved at the cathode from the interstices of the cathodic bed and prevents catholyte stagnation within the cathodic bed.

18 Claims, 1 Drawing Sheet

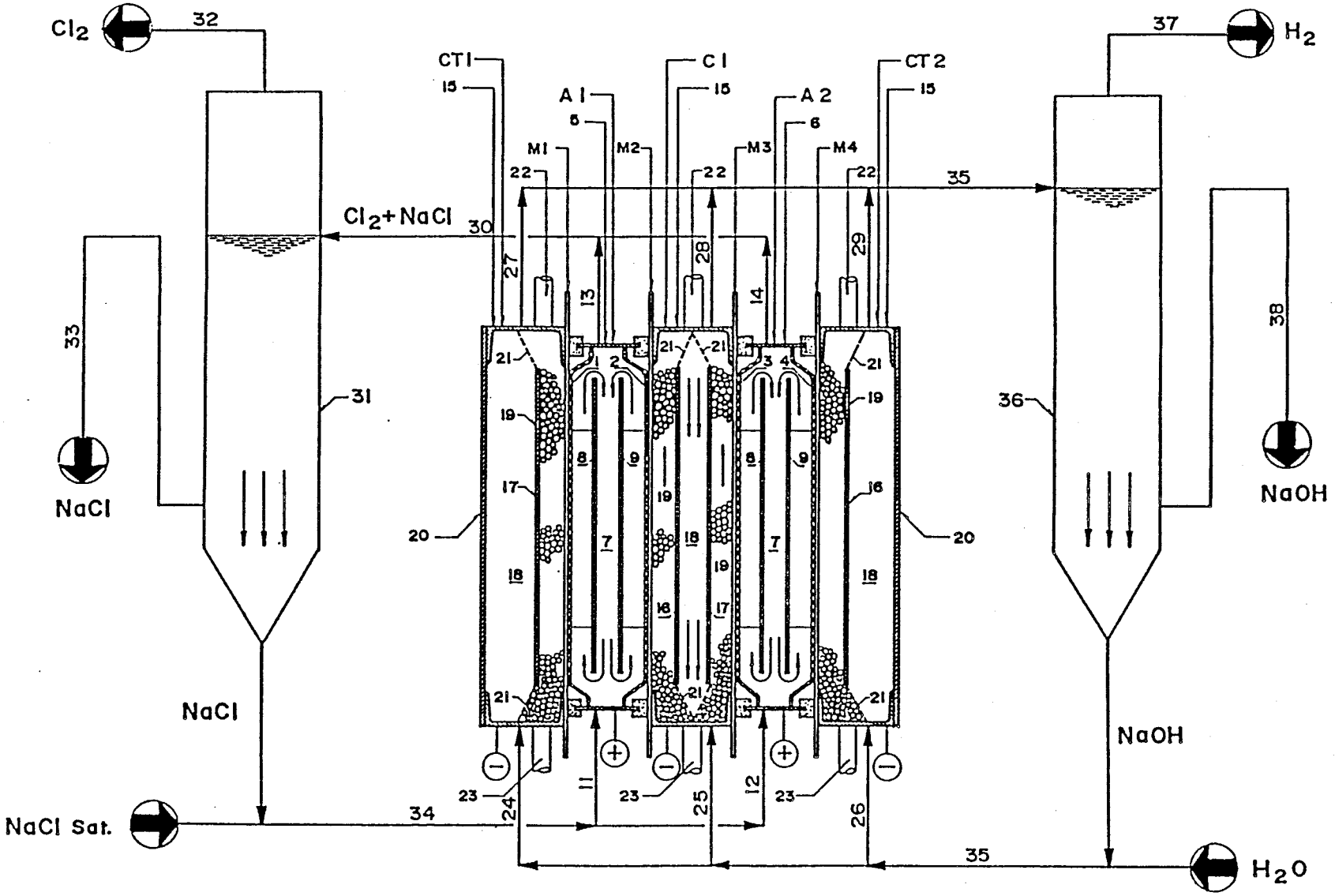
H2
NaOH
H2O
NaOH
Cl2+NaCl
Cl2
NaCl
NaCl
NaCl Sat.
CT2
A2
M4
M3
C1
M2
A1
M1
CT1

ELECTROLYSIS CELL AND METHOD OF PRODUCING CHLORINE

This application is a continuation-in-part of application Ser. No. 07/252,919 filed Oct. 4, 1988, now abandoned.

BACKGROUND OF THE INVENTION

1. Field of the invention

The present invention relates to electrochemical technologies and more in particular to methods and electrolysis cells for producing halogens by the electrolysis of aqueous solution of halides.

2. State of the art

One of the most significative innovations in this field of technology has been the adoption of hydraulically impervious, ion exchange membranes as separators between respective anodic and cathodic compartments of electrolysis cells in place of the traditional microporous asbestos diaphragms. These membranes are almost exclusively formed by at least a thin film of a perfluorinated polymer containing pendant polar groups attached to the polymeric matrix.

Another recent innovation, made possible in a way by the novel nature of the separators, has been the development of so-called "O-gap" electrolysis cells, i.e. of cells wherein the electrodes, necessarily porous, are held in direct contact with the surface of the separating element of the cell, that is of the membrane. Such a disposition of the electrodes implies, among others, the advantages of minimizing the cell voltage (ohmic drop), by minimizing the path traversed by the ionic current, together with an intrinsic ease of ensuring an almost perfect distribution of the current density across the whole cell surface, by freeing said requisite from the limitations which have always been imposed by fabrication tolerances of such large surface structures as metal screen electrodes welded on a series of current distributing metal supports.

An early electrolysis cell of this kind is described in the U.S. Reissue Pat. No. Re. 32,077. In this patent the concept of a O-gap membrane cell is exemplified by a monopolar cell containing a plurality of tubular screen anodes, cladded over their external surface by an ion exchange membrane and wherein the cathode is formed by a mass of packing material (static or fixed bed) filling completely the space between the internal walls of a cathodically polarized container of the cell and the membrane cladded surface of the tubolar anodes which traverse the cathodic compartment. Such a way of implementing an O-gap cell, though offering the advantage of an extremely easy construction, has not found widespread commercial application primarily because in producing chlorine and caustic soda in a cell equipped with a modern ion exchange membrane, the catholyte (caustic soda at 30–35% by weight) has a high density and viscosity, and the hydrogen developed on the cathode surface as minute bubbles disperses in the viscous liquid forming a gas-liquid dispersion rather difficult to separate because of the ability of hydrogen in such minute bubbles to disperse itself readily within the bulk of the liquid catholyte. In a cathodic compartment completely filled with such a packing material, the total volume of interstices among the grains or fibers of the packing material is only a small percentage of the total volume of the cathodic compartment and such a constriction of the flow of the hydrogen -catholyte dispersion through the cahodic compartment (normally from the bottom of the compartment to an outlet port placed in the top portion of the compartment) further reduces the possibilities of a fast removal of the gas from the cathodic compartment. This determines a greater than otherwise normal volumetric percentage of gas in the bulk of the catholyte within the cathodic compartment (i.e. within the catholyte traversed by flux lines of ionic electric current). This fact is notably negative as it tends to increase the ohmic drop (cell voltage).

In order to overcome these limitations, a large number of ion exchange membrane cell configurations have been proposed, wherein the desired O-gap condition is obtained by pressing more or less uniformly by resilient means such as springs or other similar elastic structures, a screen electrodic structure (normally a cathode but in some cases an anode) against the surface of the separating membrane of the cell, which membrane being commonly flexible is pushed against a restraining surface provided by the cell counterelectrode which has a substantially rigid nature. U.S. Pat. Nos. 4,340,452; 4,530,743; 4,444,632; and 4,536,263 are some examples of as many O-gap cells of this kind.

The quest of a cell configuration capable of associating the advantages of the O-gap configuration to the utilization of essentially flat screen electrode structures which leave empty the remaining space of the electrodic compartment for favoring a fast fluid circulation in and out of the compartment, besides allowing the construction of modular filter press type cells, has lead to the development of cell structures wherein the problems of satisfying stringent fabrication tolerances in terms of planarity, parallelism of structures, have represented themselves in order to prevent "pinching" of the membrane at points more stressed than others, and more in general have led to complex and costly cells.

SUMMARY OF THE INVENTION

By contrast, through the cell object of the present invention the advantages proper of utilizing a packing type cathode are entirely recovered, simultaneously obviating the problems caused by such a packing type cathode and realizing further a modular type cell which may be assembled in a filter-press arrangement as a state-of-the-art cell having both its electrodes in the form of screens.

The instant invention also contemplates an improved method for producing chlorine by the electrolysis of an aqueous sodium chloride solution utilizing the cell of the invention.

Such objectives and advantages are obtained by the cell and the method of the invention so as recited in the claims annexed hereto.

BRIEF DESCRIPTION OF DRAWING

The sole FIGURE is a schematic flow diagram illustrating an apparatus according to the present invention.

DETAILED DESCRIPTION OF THE INVENTION

Essentially, the cell of the invention utilizes a packing type cathode, i.e. a cathodic structure formed by a static or fixed bed of a packing material which is resistant to the cathodic conditions of contact with caustic solutions and to the cathodic discharge of hydrogen ions, confined between a baffle or cathodic current distributing plate and the membrane of the cell which are substantially parallel one to the other and are spaced by a distance sufficient to accommodate in the space between the two opposing surfaces of the current distributing plate and of the membrane such a static cathodic bed. The current distributing plate confining such a cathodic bed separates the latter from a recycle space within the cathodic compartment of the cell, through which the catholyte reaching the uppermost part of the cathodic bed may downflow toward the bottom of the cathodic compartment, thus creating a recycling motion within the cathodic compartment of the cell which favors a remarkable separation between the gaseous phase and the liquid phase of the dispersion, or between a gas/catholyte gas rich phase of the dispersion which flows out of the top of the cathodic compartment and a gas (residual)/catholyte gas depleted phase of the dispersion which downflows toward the bottom of the cathodic compartment through said recycle space behind said current distribution plate which confines the cathodic bed.

A strong recycling motion is induced by a great density difference between a gas/catholyte dispersion raising through the interstices of the cathodic bed (the dispersion gathering more and more bubbles of the gas being evolved over the surfaces of the particles forming the cathodic bed while raising through it) in respect to the density of the at least partially de-gassed catholyte which downflows toward the bottom of the compartment and this recycling motion provides a strong catholyte renewal action within (and concurrently favors evacuation of the cathodic gas from) the interstices of the packing type cathode. This effectively ensures a constant and more easily controlled concentration of catholyte in such a critical zone as well as a substantial reduction of the volumetric percentage of gas dispersed in the catholyte.

These are conditions which notably favor a reduction of the cell voltage, an improved cathodic efficiency and a longer life of the membrane.

According to a preferred embodiment, the cell of the invention is composed of an assembly of modules or electrodic units of alternating polarity in a filter-press configuration. Each anodic unit is conveniently placed between two cathodic units and is separated from these by two ion exchange membranes. Thus, a cell may be formed by an anodic unit and by two terminal cathodic units. Otherwise, between two terminal cathodic units may be inserted anodic units and intermediate type cathodic units in a substantially illimited number or limited exclusively by practical considerations for providing suitable compression means for the filter-press assembly (tie-rods and springs for accommodating thermal expansions of the assembly during operation). Therefore, the anodic units or modules will be interleaved in the assembly with cathodic units or modules, with separating ion exchange membranes placed between modules or units of opposite polarity adjacent in the filter-press assembly. All the anodic units of one cell will be connected by means of appropriate terminals to current distributing bars at a certain positive potential in respect to the potential of current distributing bars connected, by means of appropriate terminals, to all the cathodic units of the cell.

The invention, its different aspects and advantages will be more easily understood through the following description of a preferred embodiment and the annexed FIGURE representing, in a schematic way, a simplified cross section of an electrolysis cell of the invention.

The cell schematically shown in the FIGURE comprises two anodic units, respectively A1 and A2, two terminal cathodic units CT1 and CT2, and one intermediate cathodic unit C1. Flexible, ion exchange membranes, respectively M1, M2, M3 and M4, separate one cathodic unit from one anodic unit adjacent to it in the filter-press assembly.

Each electrodic unit, anodic as well as cathodic, comprises a rectangular or circular frame of an electrically conducting material provided with one or more terminals for electrical connection of the frame to respective current distribution bars (schematically shown in the FIGURE by the relative polarity flags).

Each intermediate anodic unit, A1 and A2, contains two vertical screen anodes (1, 2, 3 and 4), respectively connected to the relative conducting frames 5 and 6. The conducting frames 5 and 6 of the anodic units A1 and A2 as well as the relative screen anodes 1, 2, 3 and 4 are of a suitable valve metal, electrochemically resistant to the anodic conditions such as titanium, niobium and tantalum or alloys thereof, titanium being the preferred valve metal. The screen anodes have at least part of their surface covered by a suitable non-passivatable coating, electrochemically resistant to the passage of anodic current. Various non-passivatable materials, particularly catalytic for chlorine evolution, are known in the art so as it is known their application on valve metal substrates such as titanium.

Examples of such catalytic materials are the oxides, mixed oxides and oxycompounds of at least a noble metal, i.e. belonging to the group composed by platinum, ruthenium, rhodium, iridium and palladium, often in association with oxides and compounds of valve metals. These catalytic and non-passivatable materials are applied on the surface of a valve metal screen substrate commonly by means of thermal decomposition under oxidizing atmosphere of a paint solution containing precursor compounds of at least a noble metal and eventually also of a valve metal.

According to the embodiment shown in the FIGURE, between the two screen anodes of each intermediate anodic unit is created a recycle space 7 by means of a pair of substantially parallel and spaced baffles or plates (8 and 9) placed in a substantially parallel and intermediate position in respect to the two screen anodes of the anodic unit. These baffles are conveniently made of titanium sheets and extend from an internal vertical wall of the anodic frame to the opposite vertical wall and may be welded thereto. The pair of baffle sheets 8 and 9 forms a channel or recycle space 7 open toward the bottom and toward the top of the anodic compartment.

The frames 5 and 6 of the anodic units A1 and A2 are preferably formed by a substantially flat titanium plate without any flange portion. Along the entire perimeter and on both sides of the anodic frames 5 and 6 a gasket 10 of an elastomer, resistant to the anolyte and to the anodic products of electrolysis (e.g. EPDM) and having a cross section substantially shaped as a "C",is fitted over the edges of the titanium plate forming the frame of the anodic units.

The original solution of utilizing a single gasket which may be "pulled-on" the edge of the anodic frame offers a great advantage in terms of simplifying the assembly operations and in terms of costs.

A fluid inlet (shown respectively by the lines 11 and 12 in the FIGURE) is present through the bottom of the anodic units for introducing brine in the anodic compartments and a fluid outlet (shown respectively by the lines 13 and 14 in the FIGURE) is present through the top portion of the frame of each anodic unit for recovering depleted brine and halogen gas evolved on the anodes.

The intermediate cathodic unit C1 comprises a metallic frame 15 of a "C" profiled material providing two flange surfaces for sealingly matching with the gasket carrying frame of the adjacent anodic unit. A pair of electric current distribution plates 16 and 17, substantially parallel and spaced one from the other and in an intermediate position in respect to the width of the cathodic compartment (of the cathodic frame), extend from the internal surface of a vertical side of the frame, onto which are welded, to the internal surface of an opposite vertical side of the frame, onto which are also welded. The pair of hydraulically impervious plates 16 and 17 extends in a vertical direction for the greater part of the heignt of the cathodic compartment, although short of reaching down to the bottom and of reaching up to the top of the compartment. In this way, the two plates 16 and 17 define, within the cathodic compartment, a recycle space 18 open toward the bottom as well as toward the top of the compartment.

The space between each one of said two current distributing plates 16 and 17 and the opposing surface of the relative separating membrane is filled with a static porous bed 19 of an electrically conducting and cathodically resistant packing material.

The two terminal cathodic units CT1 and CT2 have a basic configuration similar to that of the intermediate cathodic unit C1 except for the fact that a single current distributing plate 16 or 17 is employed for confining and for transmitting the electric current to the relative porous static bed 19 contained between the surface of this single plate and the opposing surface of the relative separating membrane (M1 or M4). The recycle space 18 is, in the case of the two terminal cathodic units, defined by the rear surface of the current distributing plate (16 or 17) and a terminal wall 20 of the cathodic compartment which may be conveniently welded on the flanged portion of the respective frames 15.

Screens or porous mats 21 having a pore size smaller than the minimum size of the particles or fragments which form the porous cathodic static bed 19 are placed across the openings of the recycle spaces 18 toward the bottom and toward the top of their respective cathodic compartments for preventing these particles or fragments from encroaching in the recycle spaces or channels 18. Such porous mats or screens may be of any catholyte resistant material.

The packing material forming the static cathodic bed 19 may be introduced inside the cathodic compartments through appropriate loading nozzles 22 (provided with suitable leakproof closing means, not shown in the FIGURE, to prevent losses of cathodic products of the electrolysis). An additional nozzle 23 may also be provided through the bottom of the cathodic compartments for discharging the packing material forming the cathodic static bed 19 when the filter-press assembly must be opened for replacing exhausted membranes or for other maintenance operations, or for proceeding to renew the packing material itself inside the cathodic compartments in those instances where, as it will be described later, the packing fragments or particles are activated by means of a catalytic coating which must be renewed after a certain period of operation. Therefore, it is possible to proceed to load the packing material inside the various cathodic units after having assembled the cell.

Through the bottom of the frame of each cathodic unit there is a fluid inlet (shown in the FIGURE by the lines 2', 25 and 26) for introducing dilution water inside the cathodic compartments.

A fluid outlet is provided through the top portion of the frames of the cathodic units (shown in the FIGURE by the lines 27, 28 and 29) for recovering the cathodically evolved gas ($H_2$) and the catholyte (aqueous solution of alkali metal hydroxide).

The cathodic frames 15, the end walls 20 of the two terminal cathodic units CT1 and CT2, the relative inlet and outlet nozzles the current distributing plates 16 and 17, the porous mats 21 as well as the packing material forming the porous cathodic static bed 19 inside the variuos cathodic units may be of nickel, or of any other metallic material coated with a layer of nickel by galvanic or electroless techniques, or of a stainless steel which does not passivate at the contemplated cathodic polarization conditions in the catholyte. The structural members of the cathodic units, such as the frames 15 and the end walls 20 may also be built with steel cladded over the surfaces exposed to the contact with the catholyte with a thin sheet of nickel, while the plates 17 and 16 may be of nickel so as the packing material forming the static bed 19. The packing material may have different shapes such as those belonging to the group formed by balls, cylinders, semicylinders, saddles, Raschig rings, granules and fibers. Particularly preferred is the ball shape for its superior "flowing" characteristics within relatively narrow spaces. Preferably nickel or stainless steel balls are utilized having their diameter comprised between 2 and 5 millimeters. This range of dimensions of the packing balls has been found particularly suited for forming cathodic static beds having normally a thickness comprised between 10 and 20 millimeters, a height of about 1200 millimeters and a width of about 500 millimeters (corresponding more or less to the real dimensions of a cathodic unit). In the schematic illustration of the FIGURE it is also shown the system of the hydraulic connections of the anodic and cathodic compartments of the cell. In particular, in the case of electrolysis of sodium chloride to produce chlorine, caustic soda and hydrogen, chlorine and depleted brine effluent from the anodic compartments through the outlets 13 and 14 are conveyed, through the line 30, to a gas-liquid separator vessel 31, from the top of which chlorine is recovered through the line 32. Through a gooseneck 33, depleted brine, substantially de-gassed, is conveyed to a resaturation plant. By adjusting the relative flows of resaturated brine and of depleted brine coming from the bottom of the separator vessel 31, a brine with an esaily controllable constant concentration is introduced through the bottom of the anodic compartments through the line 34.

In a similar way to that of the anodic fluids, hydrogen and caustic soda, produced in the cathodic compartments, are conveyed through the line 35 to a gas-liquid separator vessel 36, from the top of which hydrogen is recovered through the line 37. Through a gooseneck outlet 38, the produced caustic soda is recovered, while a portion of the substantially de-gassed caustic soda, taken from the bottom of the separator 36, is mixed with dilution water and such a diluted caustic soda solution is introduced in the cathodic comparments through the line 39 in order to dilute and to keep constant and under control the concentration of caustic soda inside the cathodic compartments of the cell.

During operation, gaseous hydrogen is continuously evolved on the active surface of the cathodes of the cell, e.g. on the surface of particles of the cathodic static bed 19 which are closer to the surface of the separating membrane, that is to the counter electrode (anode) constituted by the coated titanium screen onto which the flexible separating membrane is pushed by the weight of the cathodic static bed. Hydrogen evolves from the discharging cathodic surfaces as minute bubbles which easily disperse within the liquid phase constituted by an aqueous solution of hydroxide of the alakali metal. This gas ($H_2$) - liquid (NaOH at 30–35% b. wt.) dispersion which occupies the interstices among the various particles forming the cathodic static bed 19 witin each cathodic compartment, gathering more and more gas bubbles, raises through the porosity of the cathodic static bed, dragged by the buoyancy of the hydrogen bubbles and reaches the top of the cathodic bed. In the top portion of the cathodic compartment, above the summit of the cathodic static bed, a partial subdivision of the gas-liquid dispersion takes place. That is a gas rich phase of the dispersion flows out of the cathodic compartment through the relative fluid outlet while a phase of the dispersion with a much reduced gas content, i.e. a more dense phase, downflows through the recycle space 18 at the back of the plate for the distribution of electric current to the cathodic static bed, thus generating a remarkable recycle motion within each cathodic compartment. This recycle motion is generated by a substantial difference in density between the gas-catholyte dispersion raising through the cathodic bed 19 (getting more and more rich in gas which is generated over the discharging cathodic surfaces of the bed) and the partially de-gassed gas-catholyte dispersion downflowing toward the bottom of the cathodic compartment through the recycle space of channel 18. The partial subdivision of phases taking place at the top of the cathodic compartment is due to a process of coalescence of hydrogen bubbles, as well as to a process of separation among physically distinguishable portions of the same gas-liquid dispersion, more or less rich in gas.

According to an aspect of the invention, such a coalescence process of the gas bubbles is aided by the presence, in such a critical zone for the generation of the recirculation process of the catholyte within the compartment, of a gas adsorbing material, such as for example polytetrafluoroethylene. According to a preferred embodiment of the invention, on the containing screens 21, in correspondence of the top opening of the recycle space 18 within each cathodic compartment, may be conveniently placed a "mat" or an unwoven cloth of polytetrafluoroethylene fibers having a porosity sufficient to avoid hindering the flow of the partially de-gassed dispersion toward the recycle space. It has been observed that the presence of such a porous layer of polytetrafluoroethylene favors the coalescence of gas bubbles producing a greater density of relatively larger (more buoyant) bubbles while the dispersion passing through the porous layer of PTFE shows a markedly reduced residual amount of dispersed minute gas bubbles.

A similar effect may be obtained also placing fibers or particles of polytetrafluorethylene directly over the cathodic static bed or in the uppermost layers of the latter. For example, down for as much as one third of the height, starting from its top, the cathodic static bed may be formed by an appropriate mixture of metallic particles (nickel balls) and of polytetrafluoro ethylene particles such as balls or fibers.

A sufficiently fast removal of the cathodically evolved gas from the cathodic static bed whose difficulty in obtaining it has discouraged if not prevented until now a commercial use of a cathode in the form of a static bed in cells for producing halogens notwithstanding the undoubted advantages that such a cathodic structure is capable of offering, is effectively obtained by the cell of the present invention which exploits a recirculation motion within the cathodic compartment generated by a density difference between a gas rich dispersion raising through interstices of a cathodic static bed and a partially de-gassed dispersion downflowing through a recycle space within the cathodic compartment.

A similar recycle motion within the electrodic compartment may also be generated in the anodic compartment by a pair of baffles 8 and 9 which defines a recycle space 7 for brine partially de-gassed of the gaseous phase contained therein, represented by chlorine bubbles which evolve on the discharging surface of the screen anodes. Although on the anodic side does not exist a technical problem as limiting as the one discussed in relation to the cathodic side of the cell, inducing a recycling motion within the anolyte contained into the anodic compartments of the cell may add the advantage of keeping more uniform the concentration of the anolyte across the whole cell surface which otherwise could give raise to phenomena tied to the peculiar sensitivity of the ion exchange membrane material to marked differences of concentration of the anolyte in contact thereto (liquid electrolyte/solid electrolyte interface phenomena)

The membranes preferably used in the cell of the invention are membranes with characteristics suitable for the operation in O-gap cells, as known by the skilled technician. Therefore, these membranes may have a laminated structure (i.e. formed by laminated layers of different composition) and particularly they may have a porous layer of particles of a hydrophylic, inorganic material resistant to corrosion (e.g. silicates, titanium dioxide, etc.) at least on the surface facing the cathodic compartment of the cell and in direct contact with the catholyte. Such a microporous layer favors the "wettability" of the membrane surface by the catholyte, thus opposing filming of the surface by molecular hydrogen which, being evolved directly in contact with the surface of the membrane (the static bed cathode bearing against the membrane), tends to be adsorbed and to "stick" to the surface of the membrane whose perfluorinated polymer structure would be otherwise too adsorbtive towards hydrogen.

The intrinsic ability of the fixed bed of packing material to distribute uniformy within the available space and consequently of obviating any planarity and parallelism deviations of the substantially rigid screen counter-electrode makes the cell of the invention particularly useful also in case the membrane be provided, on one or the other or on both its major surfaces, with a porous layer containing particles of a catalytic material. In case the membrane has such a porous layer of catalytic material on the surface facing toward the cathodic compartment of the cell, such a catalytic material will be a material resistant to the catholyte and having a low hydrogen over-voltage. In this case, the cathodic static bed 19 contained between the current distribution plate and the surface of said catalytic porous layer adherent to the membrane will operate satisfactorily as a cathodic current collector of such a composite cathode, which may be considered represented by said porous layer of catalytic material, adherent to the surface of the membrane.

In all similar situations, that is also in case the membrane has a porous layer of catalytic material on the anode side thereof acting as a discharging anode, as well as when the membrane has such catalytic electrodes bonded to both sides thereof, one of the main technical problems is represented by the requirement of uniformly contacting said catalytic layers bonded to the membrane with a suitable electric current feeder or collector, by discrete point of contact, extremely close one to the other, throughout the whole cell surface. In all these cases, the adaptability characteristics to any profile possessed by the cathodic static bed of the cell of the invention permits to establish in a simple and effective way such a contact between the current feeding or collecting structures and the porous catalytic layers bonded to the surfaces of the membrane.

Generally, such catalytic porous layers formed on the surface of the membrane contain at least an oxide or a mixed oxide of a metal belonging to the group composed by platinum, iridium, ruthenium, palladium, rhodium and tin, in case the catalytic layer must operate as an anode.

In case the porous catalytic layer formed on the surface of the membrane must operate as a cathode, the catalytic material will contain at least an oxide, a mixed oxide, an intermetallic compound, a metallic black or mixtures thereof of at least a metal belonging to the group composed by platinum. iridium, ruthenium. rhodium, palladium and nickel.

In any case, whether the membrane has a cathodic catalytic porous layer or not, the cathodic bed will operate, at least partially, as a cathode because also in the presence of such a catalytic layer, a portion of the ionic current will discharge also on the particles of the cathodic bed which are nearer to the layer. Therefore, according to a preferred embodiment, the particles of nickel or of other material coated with nickel forming the cathodic bed are preferably activated by a catalytic coating having a low hydrogen overvoltage.

It is preferred to coat the balls or other differently shaped particles of the cathodic packing with a superficial layer containing at least an oxide, a mixed oxide, an intermetallic compound, or a metallic black of at least a metal belonging to the group composed by platinum, iridium, ruthenium, rhodium, palladium and nickel. The coating of the balls or of the differently shaped particles of the bed may be effected by painting the surface of the particles with a solution containing appropriate precursor compounds of the desired metals followed by a chemical decomposition heat treatment under an oxidizing atmosphere for generating a ceramic coating based upon oxides of the selected metals, or under a reducing atmosphere for generating a substantially metallic or intermetallic coating. Galvanic deposition, electroless deposition, plasma deposition and other known techniques for depositing materials on the surface of substrates may be also utilized. Of course, the balls or the differently shaped particles are coated with the selected catalytic material before being introduced in the cathodic compartments and may be periodically substituted with re-activated material by first discharging the disactivated or otherwise exausted packing material through the described discharge nozzles and reforming the cathodic bed by introducing re-coated or freshly activated packing material through the loading nozzle of the cathodic units.

We claim:

1. A cell for the electrolysis of an aqueous solution of an alkali metal halide comprising at least a cathodic unit, containing at least a vertical cathode, and an anodic unit, containing at least a vertical anode, combinable in a filter press assembly, each unit defining a compartment with fluid inlets and outlets, respectively, in proximity the bottom and to the top of an electrically conducting frame of each unit and further comprising a flexible ion exchange, hydraulically impermeable, vertically oriented membrane which hydraulically separates the compartment of an anodic unit from the compartment of a cathodic unit, said vertical anode having the shape of a planar, substantially rigid and electrically conducting screen placed adjacently parallel to a face of the membrane and electrically connected to the conducting frame of the respective anodic unit, wherein said vertical cathode is a porous static bed of a conducting and cathodically resistant packing material contained between a surface of said membrane opposing the cathodic compartment and a vertically extended current distributing hydraulically impermeable plate of a conducting and cathodically resistant material, spaced from and parallel to said surface of the membrane and electrically connected to the frame of the respective cathodic unit, said current distributing plate defining, inside the relative cathodic compartment, a downflow space for a de-gassed catholyte open toward the bottom and toward the top of the compartment and separating said static bed from said downflow space.

2. The cell according to claim 1, wherein said downflow space for the de-gassed catholyte within the cathodic compartment has screens across an opening toward the top and toward the bottom of the compartment preventing the packing material forming said static bed from encroaching inside said downflow space.

3. The cell according to claim 2, wherein said screen across the opening toward the top of the compartment of said catholyte downflow space within the cathodic compartment comprises a porous mass of fibers of a gas adsorbing material.

4. The cell according to claim 3, wherein the gas adsorbing material is polytetrafluorethylene.

5. The cell according to claim 1, wherein at least a top portion of said static bed contains particles of a gas adsorbing material.

6. The cell according to claim 1, wherein each anodic unit is placed between two cathodic units in the filter press assembly and contains two screen anodes electrically connected to the conducting frame defining the anodic compartment, a pair of substantially parallel conducting plates spaced one from the other and substantially parallel and in an intermediate position in respect to said two screen anodes extends from one vertically extending wall to the opposite vertically extending wall of the frame, forming a downflow space for a de-gassed anolyte open toward the bottom and toward the top of the anodic compartment.

7. The cell according to claim 1, wherein each anodic unit is placed between two cathodic units in the filter press assembly and contains two screen anodes connected to the conducting frame, said frame being formed with a substantially flat plate of a valve metal without any flange portion, sealing being provided by a gasket having substantially a "C" shape fitted over the edge of the flat plate forming said conducting frame of the anodic unit and pressed against a flange surface belonging to the adjacent cathodic unit of the filter press assembly.

8. The cell according to claim 7, wherein said membrane is provided with a superficial porous layer of particles of a hydrophylic inorganic corrosion resistant material at least on the surface facing the cathodic compartment of the cell.

9. The cell according to claim 7, wherein the membrane is provided with a porous layer containing particles of a catalytic material on at least one surface.

10. The cell according to claim 9, wherein the membrane has said porous layer on the surface facing the anodic compartment of the cell and said catalytic material is a material resistant to the anolyte and to anodic products.

11. The cell according to claim 10, wherein said catalytic material contains at least an oxide or a mixed oxide of a metal belonging to the group consisting of platinum, iridium, ruthenium, palladium, rhodium and tin.

12. The cell according to claim 9, wherein the membrane has said porous layer on the surface facing the cathodic compartment of the cell and said catalytic material is a material resistant to caustic soda and has a low hydrogen overvoltage.

13. The cell according to claim 11, wherein said catalytic material contains at least an oxide, a mixed oxide, an intermetallic compound, a metallic black or mixtures thereof of at least a metal belonging to the group consisting of platinum, iridium, ruthenium, rhodium, palladium and nickel.

14. The cell according to claim 1, wherein said static bed is substantially formed by a packing material having at least the surface thereof formed by a metal belonging to the group consisting of nickel, iron and alloys thereof.

15. The cell according to claim 14, wherein said packing material has a shape belonging to the group consisting of balls, cylinders, semi-cylinders, saddles, Raschig rings, grains and fibers.

16. The cell according to claim 14, wherein said packing material is coated with a superficial layer containing at least a catalytic material belonging to the group consisting of platinum, iridium, ruthenium, palladium, rhodium, nickel and oxides, mixed oxides, intermetallic compound, metallic blacks of said metals.

17. A method for generating chlorine by electrolysis of an aqueous solution of an alkali metal chloride comprising conducting the electrolysis in a cell having a flexible, hydraulically impermeable, ion exchange membrane vertically disposed and separating an anodic compartment containing a foraminous anode extending along a face of the membrane, from a cathodic compartment containing a static bed cathode extending along the other face of the membrane and confined between the membrane and a hydraulically impermeable cathodic current distribution baffle plate, parallel and spaced from the face of the membrane, which defines, within the cathodic compartment, a downflow recycle space open toward the top and toward the bottom of the compartment, free of particles constituting said static bed cathode, circulating an aqueous solution of an alkali metal chloride through the anodic compartment in contact with said foraminous anode;

diluting the alkali metal hydroxide which forms within the cathodic compartment by feeding water inside the compartment and simultaneously recovering from the compartment a concentrated hydroxide solution;

continuously recycling a partially de-gassed aqueous solution of alkali metal hydroxide from the top portion of the cathodic compartment to the bottom thereof through said recycle space by a density difference existing between a gas rich dispersion raising said static bed cathode and a partially degassed dispersion downflowing through said recycle space.

18. The method according to claim 17, further characterized by recovering a portion of the gas-liquid dispersion from the top of the cathodic compartment of the cell, and by flowing the dispersion into a gas-liquid separator vessel external to the cathodic compartment and by recycling completely de-gassed liquid from the bottom of said separator to the bottom of the cathodic compartment and by adding dilution water to the degassed liquid stream before entering the bottom of the cathodic compartment.

* * * * *